US010233391B2

(12) United States Patent
Myszka et al.

(10) Patent No.: US 10,233,391 B2
(45) **Date of Patent: *Mar. 19, 2019**

(54) METHOD AND SYSTEM FOR IMPROVING SPATIAL EFFICIENCY OF A FURNACE SYSTEM

(71) Applicant: AMEC FOSTER WHEELER USA CORPORATION, Houston, TX (US)

(72) Inventors: Ronald T. Myszka, Saylorsburg, PA (US); Bruce T. Young, Mendham, NJ (US)

(73) Assignee: AMEC FOSTER WHEELER USA CORPORATION, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/400,500

(22) Filed: Jan. 6, 2017

(65) Prior Publication Data

US 2017/0114278 A1 Apr. 27, 2017

Related U.S. Application Data

(63) Continuation of application No. 14/964,235, filed on Dec. 9, 2015, now Pat. No. 9,567,528, which is a (Continued)

(51) Int. Cl.
*C10B 3/00* (2006.01)
*C10B 1/04* (2006.01)
(Continued)

(52) U.S. Cl.
CPC ..... *C10B 1/04* (2013.01); *C10B 55/00* (2013.01); *C10G 9/005* (2013.01); *C10G 9/18* (2013.01); *F27B 17/00* (2013.01)

(58) Field of Classification Search
CPC ..... F27B 17/00; C10B 55/00; C10G 9/005; C10G 9/18
See application file for complete search history.

(56) References Cited

U.S. PATENT DOCUMENTS 2,151,386 A 3/1939 De Florez
3,671,198 A 6/1972 Wallace
(Continued)

FOREIGN PATENT DOCUMENTS

DE 2117755 A1 2/1972
EP 1295930 A1 3/2003

OTHER PUBLICATIONS

Young, Lee W., "International Search Report" prepared for PCT/US13/29665 as dated May 13, 2013, 3 pages.

*Primary Examiner* — Gregory A Wilson
(74) *Attorney, Agent, or Firm* — Winstead PC

(57) ABSTRACT

A furnace system includes at least one lower radiant section having a first firebox disposed therein and at least one upper radiant section disposed above the at least one lower radiant section. The at least one upper radiant section has a second firebox disposed therein. The furnace system further includes at least one convection section disposed above the at least one upper radiant section and an exhaust corridor defined by the first firebox, the second firebox, and the at least one convection section. Arrangement of the at least one upper radiant section above the at least one lower radiant section reduces an area required for construction of the furnace system.

18 Claims, 6 Drawing Sheets

Related U.S. Application Data continuation of application No. 13/789,039, filed on Mar. 7, 2013, now Pat. No. 9,239,190.

(60) Provisional application No. 61/680,363, filed on Aug. 7, 2012.

(51) Int. Cl.

| | |
|---|---|
| ***F27B 17/00*** | (2006.01) |
| ***C10B 55/00*** | (2006.01) |
| ***C10G 9/00*** | (2006.01) |
| ***C10G 9/18*** | (2006.01) |

(56) References Cited

U.S. PATENT DOCUMENTS

| | | | | |
|---|---|---|---|---|
| 3,938,475 | A | 2/1976 | O'Sullivan et al. | |
| 4,332,546 | A * | 6/1982 | Bacsik | C10G 9/20 110/162 |
| 4,373,702 | A * | 2/1983 | Jayaraman | F27B 9/10 266/103 |
| 4,658,762 | A | 4/1987 | Kendall | |
| 4,986,222 | A | 1/1991 | Pickell et al. | |
| 5,078,857 | A * | 1/1992 | Melton | C10G 9/20 122/355 |
| 5,151,158 | A | 9/1992 | Bowen et al. | |
| 5,394,837 | A | 3/1995 | Tsai et al. | |
| 5,878,699 | A * | 3/1999 | Barnett | C01B 3/384 110/254 |
| 6,168,709 | B1 | 1/2001 | Etter | |
| 6,178,926 | B1 | 1/2001 | Worman | |
| 6,237,545 | B1 * | 5/2001 | Barnett | C10G 9/20 122/235.23 |
| 7,395,785 | B1 * | 7/2008 | Cross | C10G 9/20 122/174 |
| 7,484,478 | B2 | 2/2009 | Garg | |
| 2004/0124075 | A1 | 7/2004 | Nogueira | |
| 2012/0125813 | A1 | 5/2012 | Bridges et al. | |
| 2012/0168348 | A1 | 7/2012 | Coleman | |
| 2013/0034819 | A1 | 2/2013 | Catala | |

* cited by examiner

METHOD AND SYSTEM FOR IMPROVING SPATIAL EFFICIENCY OF A FURNACE SYSTEM

CROSS-REFERENCE TO RELATED APPLICATIONS

This application is a continuation of U.S. patent application Ser. No. 14/964,235, filed on Dec. 9, 2015. U.S. patent application Ser. No. 14/964,235 is a continuation of U.S. patent application Ser. No. 13/789,039, filed on Mar. 7, 2013 (now U.S. Pat. No. 9,239,190). U.S. patent application Ser. No. 13/789,039 claims priority to, and incorporates by reference for any purpose the entire disclosure of, U.S. Provisional Patent Application No. 61/680,363, filed Aug. 7, 2012. U.S. patent application Ser. Nos. 14/964,235 and 13/789,039 and U.S. Provisional Patent Application No. 61/680,363 are incorporated herein by reference.

BACKGROUND

Field of the Invention

The present invention relates generally to an apparatus for refining operations, and more particularly, but not by way of limitation, to furnace systems having vertically-oriented radiant sections.

History of the Related Art

Delayed coking refers to a refining process that includes heating a residual oil feed, made up of heavy, long-chain hydrocarbon molecules, to a cracking temperature in a furnace system. Typically, furnace systems used in the delayed coking process include a plurality of tubes arranged in a multiple-pass configuration. Often times, a furnace system includes at least one convection section and at least one radiant section. The residual oil feed is pre-heated in the at least one convection section prior to being conveyed to the at least one radiant section where the residual oil feed is heated to the cracking temperature. In some cases, design considerations dictate that the furnace system include multiple convection sections and multiple radiant sections. Such an arrangement requires an area of sufficient size in which to place the furnace system.

In some cases, space constraints limit the number of radiant sections that can be placed in a side-by-side arrangement in a given area. This results in the furnace system being constructed with less than an ideal number of radiant sections. Thus, it would be beneficial to design the furnace system to allow placement of multiple radiant sections or convection sections in a smaller area.

U.S. Pat. No. 5,878,699, assigned to The M.W. Kellogg Company, discloses a twin-cell process furnace utilizing a pair of radiant cells. The pair of radiant cells are arranged in close proximity to each other in a generally side-by-side orientation. An overhead convection section is placed above, and centered between the pair of radiant cells. Combustion gas is drawn into the convection section via induced and forced-draft fans. The twin-cell process furnace requires a smaller area and allows increased flexibility in heating multiple services and easier radiant tube replacement.

SUMMARY

The present invention relates to an apparatus for refining operations. In one aspect, the present invention relates to a furnace system. The furnace system includes at least one lower radiant section having a first firebox disposed therein and at least one upper radiant section disposed above the at least one lower radiant section. The at least one upper radiant section has a second firebox disposed therein. The furnace system further includes at least one convection section disposed above the at least one upper radiant section and an exhaust corridor defined by the first firebox, the second firebox, and the at least one convection section. Arrangement of the at least one upper radiant section above the at least one lower radiant section reduces an area required for construction of the furnace system.

In another aspect, the present invention relates to a method for reducing an area required for construction of a furnace system. The method includes providing at least one lower radiant section and providing at least one upper radiant section. The method further includes arranging the at least one upper radiant section above the at least one lower radiant section and providing a convection section disposed above the at least one upper radiant section. Arrangement of the at least one upper radiant section above the at least one lower radiant section reduces the area required for construction of the furnace system.

BRIEF DESCRIPTION OF THE DRAWINGS

A more complete understanding of the method and system of the present invention may be obtained by reference to the following Detailed Description when taken in conjunction with the accompanying drawings wherein.

DETAILED DESCRIPTION

Various embodiments of the present invention will now be described more fully with reference to the accompanying drawings. The invention may, however, be embodied in many different forms and should not be construed as limited to the embodiments set forth herein.

Figure 1:
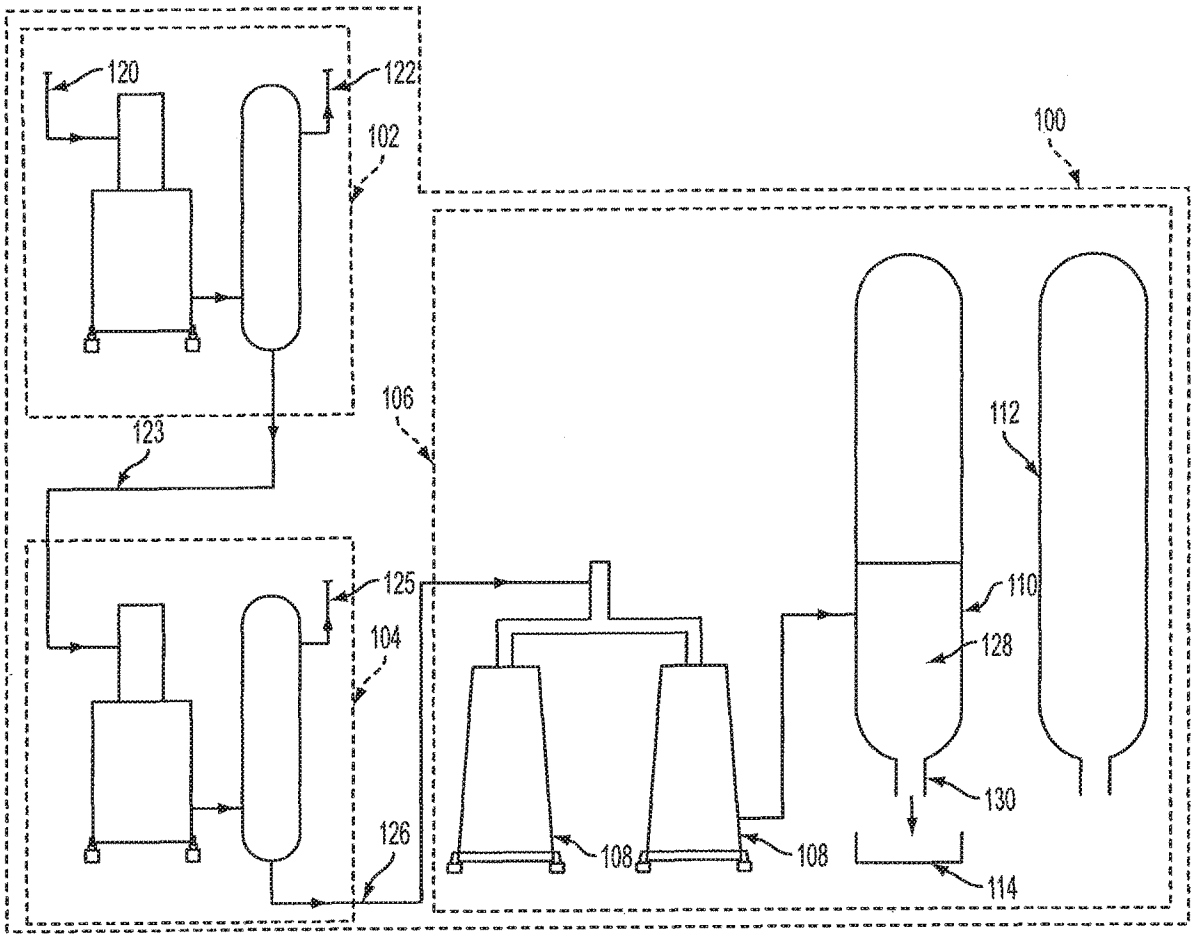
FIG. 1 is a schematic diagram of a refining system according to an exemplary embodiment.

FIG. 1 is a schematic diagram of a refining system according to an exemplary embodiment. A refining system 100 includes an atmospheric-distillation unit 102, a vacuum-distillation unit 104, and a delayed-coking unit 106. In a typical embodiment, the atmospheric-distillation unit 102 receives a crude oil feedstock 120. Water and other contaminants are typically removed from the crude oil feedstock 120 before the crude oil feedstock 120 enters the atmospheric distillation unit 102. The crude oil feedstock 120 is heated under atmospheric pressure to a temperature range of, for example, between approximately 650° F. and approximately 700° F. Lightweight materials 122 that boil below approximately 650° F.-700° F. are captured and processed elsewhere to produce, for example, fuel gas, naptha, gasoline, jet fuel, and diesel fuel. Heavier materials 123 that boil above approximately 650° F.-700° F. (sometimes referred to as "atmospheric residuum") are removed from a bottom of the atmospheric-distillation unit 102 and are conveyed to the vacuum-distillation unit 104.

Still referring to FIG. 1, the heavier materials 123 enter the vacuum-distillation unit 104 and are heated at very low pressure to a temperature range of, for example, between approximately 700° F. and approximately 800° F. Light components 125 that boil below approximately 700° F.-800° F. are captured and processed elsewhere to produce, for example, gasoline and asphalt. A residual oil feed 126 that boils above approximately 700° F.-800° F. (sometimes referred to as "vacuum residuum") is removed from a bottom of the vacuum-distillation unit 104 and is conveyed to the delayed-coking unit 106.

Still referring to FIG. 1, according to exemplary embodiments, the delayed-coking unit 106 includes a furnace 108 and a coke drum 110. The residual oil feed 126 is preheated and fed to the furnace 108 where the residual oil feed 126 is heated to a temperature range of, for example, between approximately 900° F. and approximately 940° F. After heating, the residual oil feed 126 is fed into the coke drum 110. The residual oil feed 126 is maintained at a pressure range of, for example, between approximately 25 psi and approximately 75 psi for a specified cycle time until the residual oil feed 126 separates into, for example, hydrocarbon vapors and solid coke 128. In a typical embodiment, the specified cycle time is approximately 10 hours to approximately 24 hours. Separation of the residual oil feed 126 is known as "cracking." The solid coke 128 accumulates starting at a bottom region 130 of the coke drum 110.

Still referring to FIG. 1, according to exemplary embodiments, after the solid coke 128 reaches a predetermined level in the coke drum 110, the solid coke 128 is removed from the coke drum 110 through, for example, mechanical or hydraulic methods. Removal of the solid coke 128 from the coke drum 110 is known as, for example, "cutting," "coke cutting," or "decoking." Flow of the residual oil feed 126 is diverted away from the coke drum 110 to at least one second coke drum 112. The coke drum 110 is then steamed to strip out remaining uncracked hydrocarbons. After the coke drum 110 is cooled by, for example, water injection, the solid coke 128 is removed via, for example, mechanical or hydraulic methods. The solid coke 128 falls through the bottom region 130 of the coke drum 110 and is recovered in a coke pit 114. The solid coke 128 is then shipped from the refinery to supply the coke market. In various embodiments, flow of the residual oil feed 126 may be diverted to the at least one second coke drum 112 during decoking of the coke drum 110 thereby maintaining continuous operation of the refining system 100.

Figure 2:
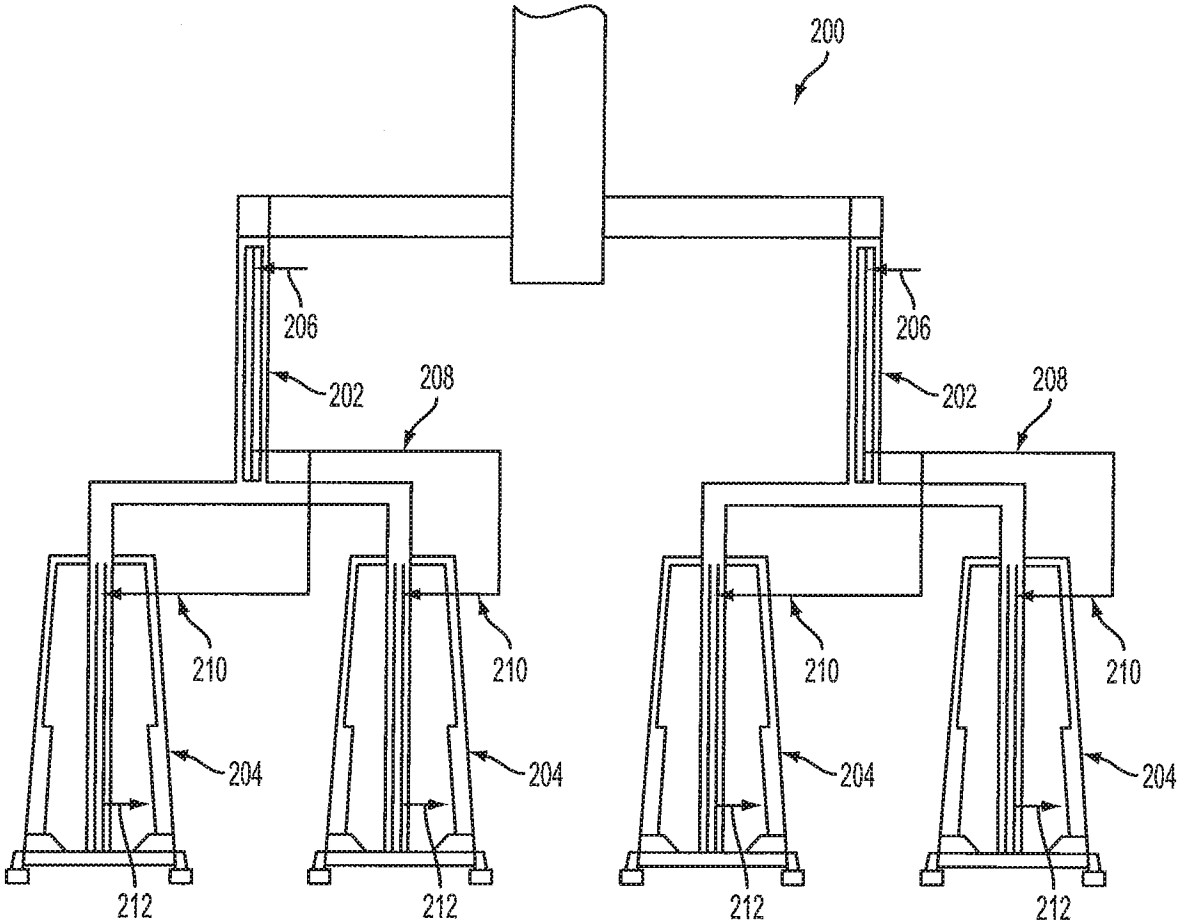
FIG. 2 PRIOR ART
FIG. 2 is a schematic diagram of a prior-art furnace system.

FIG. 2 is a schematic diagram of a prior-art furnace system. A prior-art furnace system 200 typically includes a plurality of convection sections 202 and a plurality of radiant sections 204. The arrangement depicted in FIG. 2 shows, for example, two convection sections 202 oriented generally above four radiant sections 204. The plurality of radiant sections 204 are typically oriented in a side-by-side arrangement with respect to each other. During operation, the residual oil feed 126 (shown in FIG. 1) enters one of the plurality of convection sections 202 through a convection inlet 206. Flue gas, generated by the plurality of radiant sections 204, rises through the plurality of convection sections 202 and pre-heats the residual oil feed 126. The residual oil feed 126 exits the plurality of convection sections 202 via a convection outlet 208 and is conveyed to one of the plurality of radiant sections 204. The preheated residual oil feed 126 enters the plurality of radiant sections 204 via a radiant inlet 210 and is heated to the cracking temperature. Once heated, the residual oil feed 126 leaves the plurality of radiant sections 204 via a radiant outlet 212 and is conveyed to the coke drum 110 (shown in FIG. 1).

Figure 3:
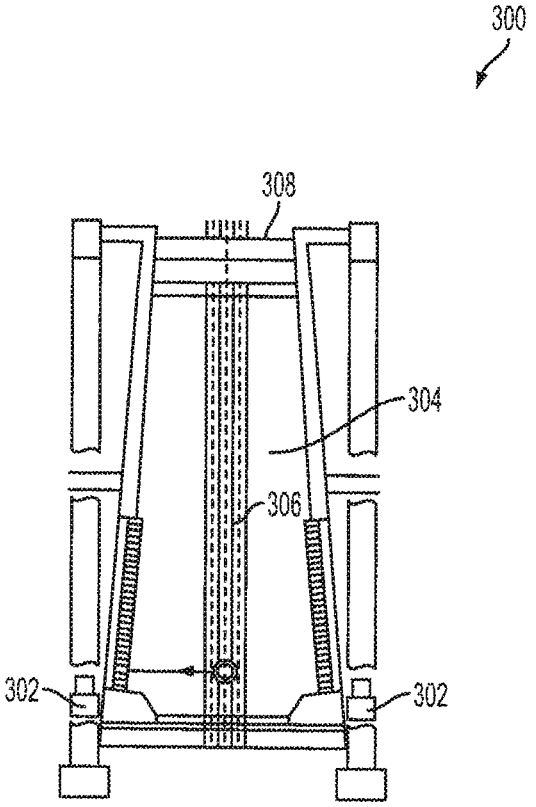
FIG. 3 is a cross-sectional view of a radiant section of a furnace system according to an exemplary embodiment.

FIG. 3 is a cross-sectional view of a radiant section according to an exemplary embodiment. A radiant section 300 includes a burner unit 302. By way of example, the radiant section 300 shown in FIG. 2 includes a pair of oppositely disposed burner units 302. A firebox 304 is defined between the pair of oppositely disposed burner units 302. A process coil 306 is disposed within the firebox 304. In a typical embodiment, the process coil 306 contains the residual oil feed 126 (shown in FIG. 1). During operation of the radiant section 300, combustion byproducts and exhaust gases, referred to as "flue gases," accumulate in the firebox 304. In a typical embodiment, the flue gasses are exhausted through an upper opening 308 of the firebox.

Figure 4:
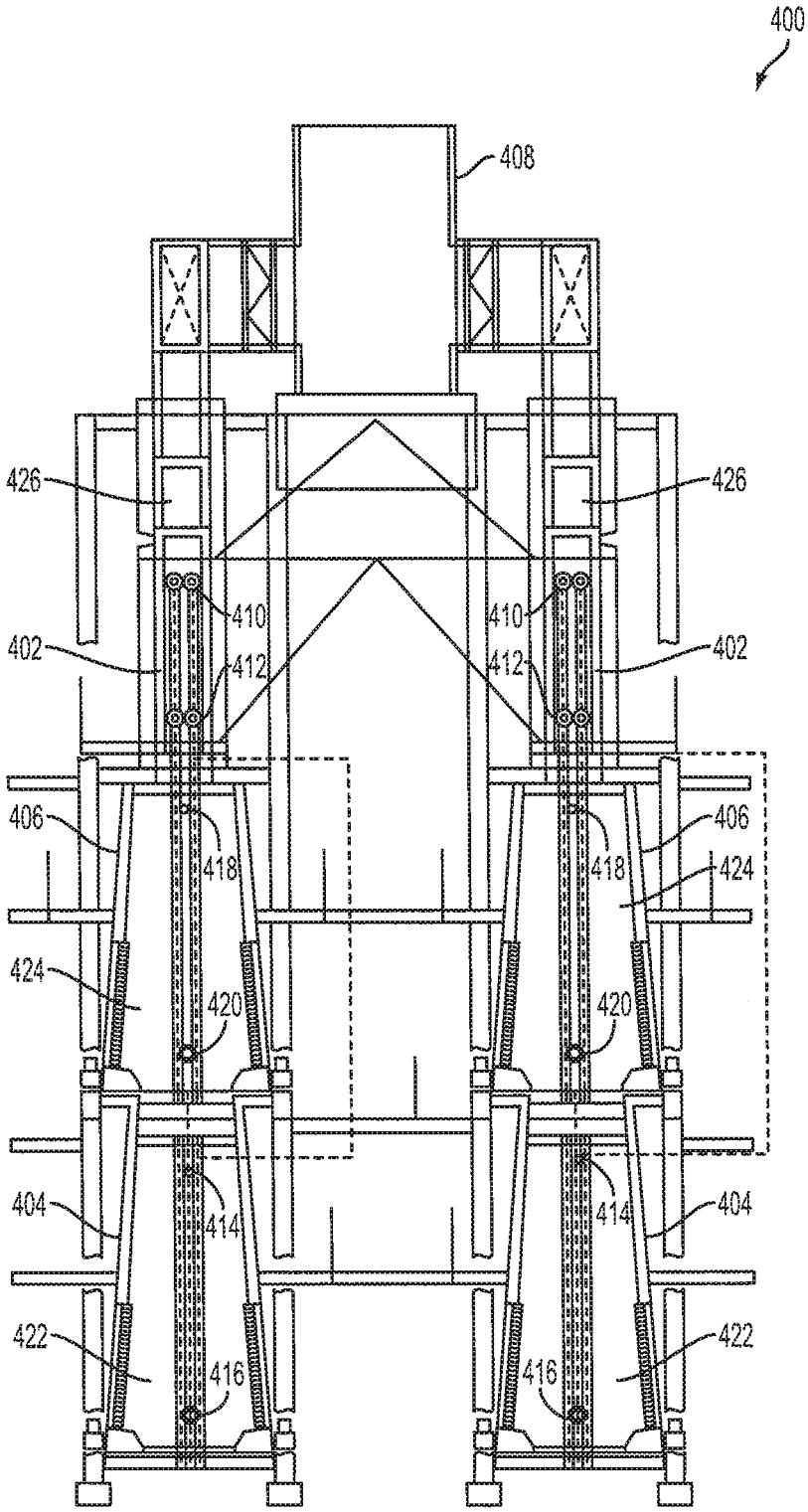
FIG. 4 is a schematic diagram of a furnace system according to an exemplary embodiment.

FIG. 4 is a schematic diagram of a furnace system according to an exemplary embodiment. A furnace system 400 includes at least one convection section 402, at least one lower radiant section 404, and at least one upper radiant section 406. By way of example, the furnace system 400 depicted in FIG. 4 illustrates, for example, two convection sections 402, two lower radiant sections 404, and two upper radiant sections 406; however, any number of convection sections 402, any number of lower radiant sections 404, and any number of upper radiant sections 406 may be utilized depending on design requirements. In a typical embodiment, the at least one upper radiant section 406 is mounted above the at least one lower radiant section 404. Arrangement of the at least one upper radiant section 406 above the at least one lower radiant section 404 allows the furnace system 400 to be constructed in a smaller area in comparison to prior art side-by-side arrangements as shown in FIG. 2. In an exemplary embodiment, the furnace system 400 shown in FIG. 4 places four radiant sections (404, 406) in an area that would ordinarily be required for a furnace system having two radiant sections (404, 406).

Still referring to FIG. 4, a first firebox 422 associated with the at least one lower radiant section 404 is fluidly coupled, and thermally exposed, to a second firebox 424 associated with the at least one upper radiant section 406. In a typical embodiment, the at least one convection section 402 is fluidly coupled, and thermally exposed, to the second firebox 424. During operation, the at least one lower radiant section 404 and the at least one upper radiant section 406 produce exhaust gasses and combustion byproducts known as "flue gases." In a typical embodiment, flue gases that have accumulated in the first firebox 422 and the second firebox 424 rise through the at least one convection section 402. The flue gases provide convective heat transfer to the at least one convection section 402. The first firebox 422, the second firebox 424, and the at least one convection section 402 together define an exhaust corridor 426 for exhaustion of the flue gases. A stack 408 is mounted above, and fluidly coupled to, the at least one convection section 402. Flue gases accumulating in the exhaust corridor 426 are exhausted through the stack 408.

Still referring to FIG. 4, the at least one convection section 402 includes a convection inlet 410 and a convection outlet 412. In similar fashion, the at least one lower radiant section 404 includes a first radiant inlet 414 and a first radiant outlet 416. The at least one upper radiant section 406 includes a second radiant inlet 418 and a second radiant outlet 420. In a typical embodiment, the convection inlet 410 receives the residual oil feed 126 (shown in FIG. 1). The convection outlet 412 is fluidly coupled to the first radiant inlet 414 and the second radiant inlet 418. In a typical embodiment, the first radiant outlet 416 and the second radiant outlet 420 are fluidly coupled to the coke drum 110 (shown in FIG. 1). In various alternative embodiments, the convection outlet 412 is fluidly coupled to the first radiant inlet 414 and a second convection outlet (not explicitly shown) is coupled to the second radiant inlet 418.

Still referring to FIG. 4, during operation, the residual oil feed 126 (shown in FIG. 1) enters the at least one convection section 402 via the convection inlet 410. The residual oil feed 126 is pre-heated in the at least one convection section 402 by convective heat transfer. Next, the residual oil feed 126 leaves the at least one convection section 402 via the convection outlet 412 and is conveyed to one of the at least one lower radiant section 404 or the at least one upper radiant section 406. The residual oil feed 126 enters the at least one lower radiant section 404 via the first radiant inlet 414. The residual oil feed 126 enters the at least one upper radiant section 406 via the second radiant inlet 418.

In the at least one lower radiant section 404 and the at least one upper radiant section 406, the residual oil feed 126 is heated to a cracking temperature in the range of, for example, between approximately 900° F. and approximately 940° F. After heating, the residual oil feed 126 leaves the at least one lower radiant section 404 via the first radiant outlet 416. The residual oil feed 126 leaves the at least one upper radiant section 406 via the second radiant outlet 420. Upon leaving the at least one lower radiant section 404 or the at least one upper radiant section 406, the residual oil feed 126 is conveyed to the coke drum 110 (shown in FIG. 1). In a typical embodiment, the at least one lower radiant section 404 and the at least one upper radiant section 406 are fluidly connected in parallel to the at least one convection section 402. However, in various alternative embodiments, the at least one lower radiant section 404 and the at least one upper radiant section 406 may be connected in series to the at least one convection section 402.

Still referring to FIG. 4, during operation, the at least one lower radiant section 404 and the at least one upper radiant section 406 are independently controlled. In a typical embodiment, a temperature of the residual oil feed 126 at the first radiant outlet 416 is substantially equal to a temperature of the residual oil feed 126 at the second radiant outlet 420. In a typical embodiment, flue gas discharged from the lower radiant section 404 will soften a flux profile of a process coil associated with the upper radiant section 406. As used herein, the term "flux profile" refers to heat input per surface area of process coil. Softening the flux profile of the upper radiant section 406 tends to increase a run length of the upper radiant section 406. That is, improved flux profile tends to increase an amount of time between required cleanings of the upper radiant section 406 due to accumulated coke.

Advantages of the furnace system 400 will be apparent to those skilled in the art. First, as previously discussed, arrangement of the at least one upper radiant section 406 above the at least one lower radiant section 404 allows the furnace system 400 to be constructed in a substantially smaller area. This is particularly advantageous in situations having critical space constraints. Second, the furnace system 400 reduces a capital investment commonly associated with many prior furnace systems. The furnace system 400 reduces a quantity of material associated with, for example, the stack 408 and as well as other associated exhaust corridors.

Figure 5:
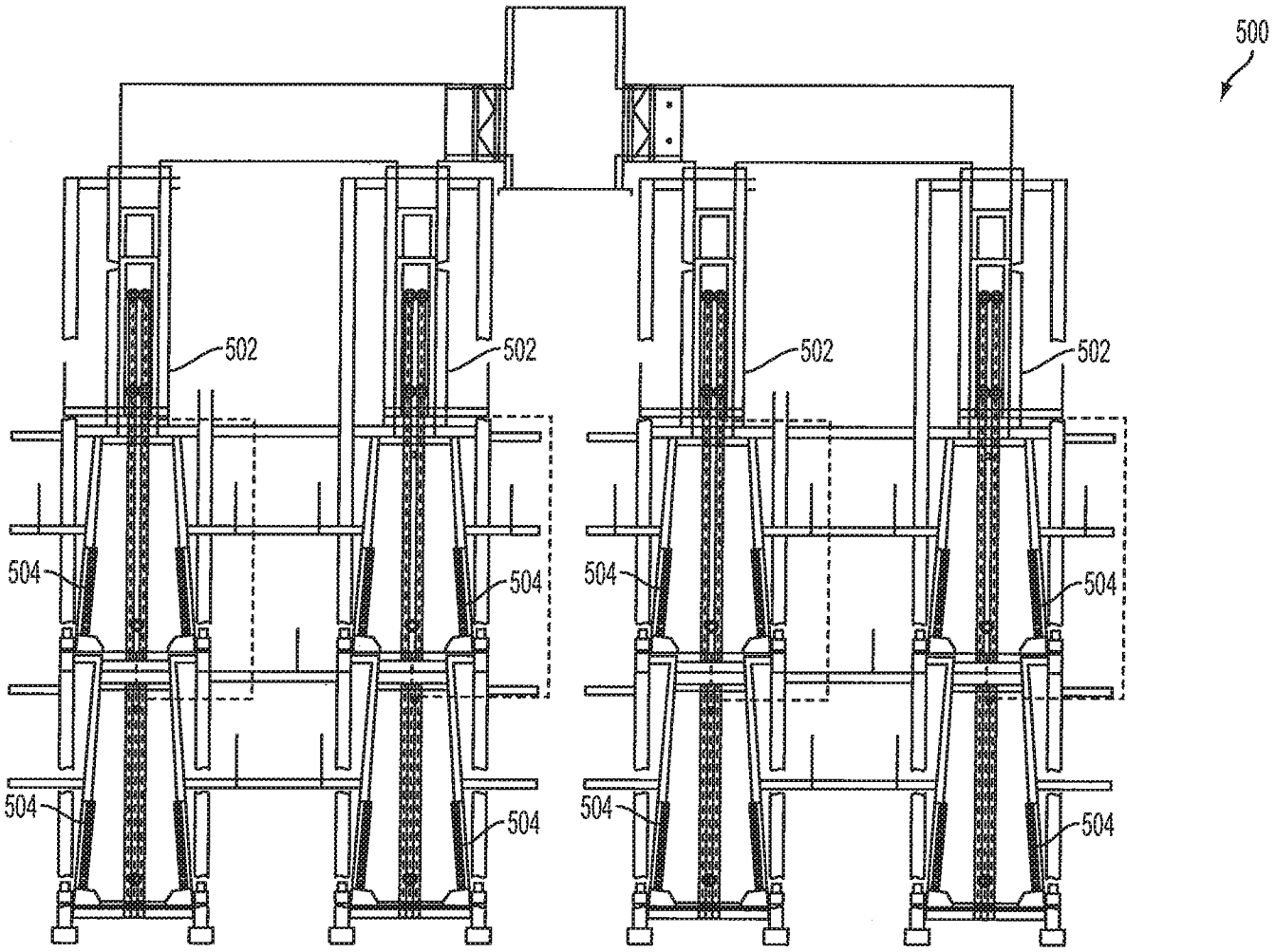
FIG. 5 is a schematic diagram of a furnace system according to an exemplary embodiment.

FIG. 5 is a schematic diagram of a furnace system according to an exemplary embodiment. A furnace system 500 includes a plurality of convection sections 502 and a plurality of radiant sections 504. In a typical embodiment, the furnace system 500 is similar in construction to the furnace system 400 discussed above with respect to FIG. 4; however, the furnace system 500 includes, for example, eight radiant sections 504 and four convection sections 502. Thus, the embodiment shown in FIG. 5 demonstrates that a furnace system 500, having eight radiant sections 504 may be constructed on an area ordinarily required for a four-pass furnace system.

Figure 6:
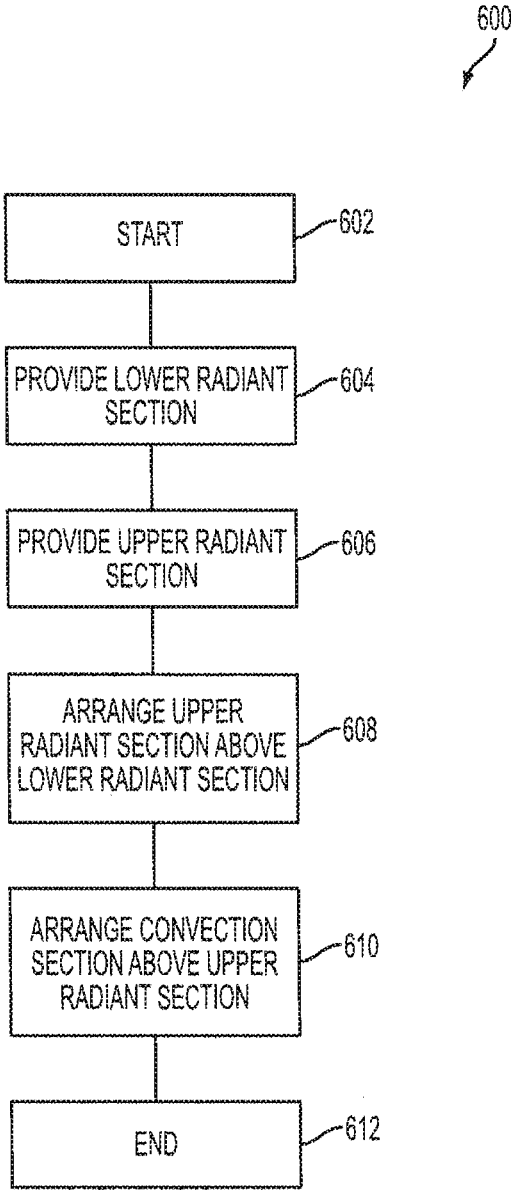
FIG. 6 is a flow diagram of a process for constructing a furnace system according to an exemplary embodiment.

FIG. 6 is a flow diagram of a process for constructing a furnace system according to an exemplary embodiment. A process 600 starts at step 602. At step 604, at least one lower radiant section is provided. At step 606, at least one upper radiant section is provided. At step 608, the at least one upper radiant section is arranged above the at least one lower radiant section. At step 610, at least one convection section is provided and disposed above the at least one upper radiant section. Arrangement of the at least one upper radiant section above the at least one lower radiant section substantially reduces an area required for the furnace system. The process 600 ends at step 612.

Although various embodiments of the method and system of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth herein. For example, although the embodiments shown and described herein relate by way of example to furnace systems utilized in delayed coking operations, one skilled in the art will recognize that the embodiments shown and described herein could also be applied to other furnace systems utilized in refining operations such as, for example a crude heater, a vacuum heater, a visc breaker heater, or any other appropriate device for heating fluid in a refining operation. Further, the furnace systems shown and described herein could, in various embodiments, include any number of convection sections, upper radiant sections, and lower radiant sections. The embodiments shown and described herein are exemplary only.

What is claimed is:

1. A furnace system comprising:

at least one lower radiant section comprising a first firebox disposed therein;

at least one upper radiant section disposed above the at least one lower radiant section, the at least one upper radiant section comprising a second firebox disposed therein, the at least one upper radiant section;

the at least one lower radiant section being controlled independently from the at least one upper radiant section;

at least one convection section disposed above the at least one upper radiant section;

an exhaust corridor defined by the first firebox, the second firebox, and the at least one convection section; and wherein arrangement of the at least one upper radiant section above the at least one lower radiant section reduces an area required for construction of the furnace system.

2. The furnace system of claim 1, wherein the at least one convection section is offset from the at least one upper radiant section and the at least one lower radiant section.

3. The furnace system of claim 1, wherein the at least one convection section comprises a convection inlet and a convection outlet.

4. The furnace system of claim 3, wherein the convection inlet receives a residual oil feed.

5. The furnace system of claim 3, wherein the at least one lower radiant section comprises a first radiant inlet and a first radiant outlet.

6. The furnace system of claim 5, wherein the at least one upper radiant section comprises a second radiant inlet and a second radiant outlet.

7. The furnace system of claim 6, wherein the convection outlet is fluidly coupled to at least one of the first radiant inlet and the second radiant inlet.

8. The furnace system of claim 6, wherein the first radiant outlet and the second radiant outlet are fluidly coupled to a coke drum.

9. The furnace system of claim 1, wherein the at least one lower radiant section and the at least one upper radiant section are connected in series.

10. A method for reducing an area required for construction of a furnace system, the method comprising:

constructing at least one lower radiant section;

constructing at least one upper radiant section;

arranging the at least one upper radiant section above the at least one lower radiant section;

arranging at least one convection section above the at least one upper radiant section;

controlling the at least one upper radiant section independently of the at least one lower radiant section;

softening a flux profile of the at least one upper radiant section via flue gasses exhausted from the at least one lower radiant section; and wherein arrangement of the at least one upper radiant section above the at least one lower radiant section reduces the area required for construction of the furnace system.

11. The method of claim 10, wherein the at least one convection section is offset from the at least one upper radiant section and the at least one lower radiant section.

12. The method of claim 10, comprising receiving a residual oil feed into the at least one convection section.

13. The method of claim 12, comprising pre-heating the residual oil feed in the at least one convection section.

14. The method of claim 12, comprising transferring the residual oil feed from the at least one convection section to at least one of the at least one lower radiant section and the at least one upper radiant section.

15. The method of claim 12, wherein a first temperature of the residual oil feed, measured at an outlet of the at least one lower radiant section is substantially equal to a second temperature of the residual oil feed measured at an outlet of the at least one upper radiant section.

16. The method of claim 10, comprising controlling the at least one lower radiant section independent of the at least one upper radiant section.

17. The method of claim 10, comprising providing convective heating to the at least one convection section via flue gasses exhausted from the at least one lower radiant section and the at least one upper radiant section.

18. The method of claim 10, comprising discharging a residual oil feed from the at least one lower radiant section and the at least one upper radiant section to a coke drum.

* * * * *